US009784029B2

(12) United States Patent
Grondin et al.

(10) Patent No.: US 9,784,029 B2
(45) Date of Patent: Oct. 10, 2017

(54) DOOR JAMB AND SILL ASSEMBLIES

(71) Applicant: Extrucan Inc., Drummondville (CA)

(72) Inventors: Jérémie Grondin, Drummondville (CA); Éric Rouillard, Saint-Eugène-de-Grantham (CA)

(73) Assignee: Extrucan Inc., Drummondville (CA)

( * ) Notice: Subject to any disclaimer, the term of this patent is extended or adjusted under 35 U.S.C. 154(b) by 7 days.

(21) Appl. No.: 14/665,467

(22) Filed: Mar. 23, 2015

(65) Prior Publication Data

US 2016/0230447 A1 Aug. 11, 2016

(30) Foreign Application Priority Data

Feb. 10, 2015 (CA) ..... 2881561

(51) Int. Cl.

| | |
|---|---|
| ***E06B 1/04*** | (2006.01) |
| ***E06B 7/23*** | (2006.01) |
| ***E06B 1/70*** | (2006.01) |
| ***E06B 7/14*** | (2006.01) |

(52) U.S. Cl.

CPC ..... *E06B 7/2316* (2013.01); *E06B 1/045* (2013.01); *E06B 1/70* (2013.01); *E06B 7/14* (2013.01); *E06B 7/231* (2013.01); *E06B 7/2303* (2013.01); *E06B 7/2305* (2013.01); *E06B 7/2312* (2013.01); *E06B 7/2314* (2013.01)

(58) Field of Classification Search

CPC . E06B 7/22; E06B 7/23; E06B 7/2305; E06B 7/231; E06B 7/2312; E06B 7/16; E06B 1/18; E06B 1/20; E06B 1/26; E06B 1/28; E06B 1/30; E06B 1/32

See application file for complete search history.

(56) References Cited

U.S. PATENT DOCUMENTS 3,184,808 A * 5/1965 Lyon ..... E06B 7/231 49/493.1
3,221,376 A * 12/1965 Smeltzer ..... E06B 5/20 49/482.1
3,469,350 A * 9/1969 Lange ..... E06B 1/045 49/504

(Continued)

FOREIGN PATENT DOCUMENTS

CA 2775167 7/2012

*Primary Examiner* — Katherine Mitchell
*Assistant Examiner* — Abe Massad
(74) *Attorney, Agent, or Firm* — Price Heneveld LLP

(57) ABSTRACT

Door jamb and sill assemblies are provided. In one aspect, a door jamb weatherstripping assembly includes a weatherstrip member and a retaining member. The retaining member is elongated and is affixed along a length of the door jamb. The retaining member defines a retaining channel for retaining an anchor portion of the weatherstrip member, and a door seal being configured to sealingly contact the face of the door parallely to a weatherstrip portion of the weatherstrip member when the door is closed. According to another aspect, an elongated cap may be secured to the retaining member in a spaced-apart arrangement to jointly form a shielding chamber along an outer portion of the jamb. In another aspect, a door sill assembly having a U-shaped body engaging the bottom edge of the door is provided. The door sill assembly may include side channel seals and bottom channel seals.

23 Claims, 11 Drawing Sheets

(56) References Cited

U.S. PATENT DOCUMENTS

| | | | | | |
|---|---|---|---|---|---|
| 3,545,135 | A * | 12/1970 | Lieber | E06B 1/30 | 16/375 |
| 3,676,966 | A * | 7/1972 | Ragland | E06B 1/6023 | 49/489.1 |
| 3,851,420 | A * | 12/1974 | Tibbetts | E06B 1/70 | 49/380 |
| 4,179,849 | A * | 12/1979 | Kuffner | E06B 1/603 | 49/505 |
| 5,058,323 | A * | 10/1991 | Gerritsen | E06B 1/347 | 49/460 |
| 5,117,587 | A * | 6/1992 | Doan | E06B 7/2309 | 49/383 |
| 5,293,723 | A * | 3/1994 | Slessor | E06B 1/30 | 49/380 |
| 5,371,987 | A * | 12/1994 | Hirsch | E06B 1/045 | 49/239 |
| 5,758,458 | A * | 6/1998 | Ridge | E06B 1/045 | 49/504 |
| 5,836,118 | A * | 11/1998 | Thornton | E06B 1/34 | 49/504 |
| 6,295,779 | B1 * | 10/2001 | Canfield | E06B 1/32 | 49/504 |
| 6,772,560 | B2 * | 8/2004 | Dischiant | E06B 7/23 | 49/197 |
| 7,171,785 | B1 | 2/2007 | Kelly et al. | | |
| 2013/0219813 | A1 * | 8/2013 | Gadoury | E06B 1/045 | 52/211 |
| 2014/0069019 | A1 * | 3/2014 | Back | E06B 7/22 | 49/484.1 |
| 2014/0259954 | A1 * | 9/2014 | Peck | E06B 7/16 | 49/489.1 |

* cited by examiner

DOOR JAMB AND SILL ASSEMBLIES

CROSS-REFERENCE TO RELATED APPLICATIONS

This application claims priority of Canadian Patent Application No. 2.881.561 filed on Feb. 10, 2015, the specification of which is hereby incorporated by reference.

TECHNICAL FIELD

The present description relates to components for weatherstripping or otherwise protecting an exterior door from the elements and more particularly concerns a jamb weatherstripping assembly and a sill assembly.

BACKGROUND OF THE INVENTION

Doors exposed to the outside of a building can be subject to water infiltration. Water can infiltrate indoor through gaps which may prevail between the perimeter of the exterior door and the doorframe, such as above the lower sill, below the header, or next to the side jambs.

Weatherstrips are commonly used to increase watertightness in the gaps between the side and top edges of a door and the door jambs. Weatherstrips are typically made of flexible, compressible and/or resilient material. Conventional weatherstrips have an anchor portion affixed to the doorframe along the jamb and a weatherstrip portion compressible between the jamb and the outer face of door; when the door is closed, the weatherstrip portion acts as a seal preventing air and water infiltration around the doorframe.

Along the sill of a door threshold, it is known to provide a sweep connected to the bottom of the door slab and having one or more downwardly projecting deflectors. The deflectors contact the door step and therefore prevent undesired infiltrations.

Jamb weatherstripping and sill assemblies can also serve functions additional to blocking the movement of water between the inside and the outside of a building. Indeed, soundproofing, thermal insulation and penetration of undesirable elements, such as insects or moisture, are, among others, also matters of interest and incentives to develop enhanced doorframe insulation.

There remains a need for door jamb and sill assemblies and components therefore which can provide an improved protection from the elements compared to known devices.

SUMMARY OF THE INVENTION

According to a general aspect, there is provided a jamb weatherstripping assembly for a jamb of a doorframe supporting a hinged door. The jamb weatherstripping assembly comprises: an elongated weatherstrip member defining an anchor portion and a weatherstrip portion longitudinally co-extending with the anchor portion; an elongated retaining member affixed to the jamb, the retaining member defining a retaining channel engaging and retaining the anchor portion of the weatherstrip member; and a door seal connectable to the retaining member and longitudinally co-extending with the retaining channel when connected thereto, the door seal and the weatherstrip portion of the weatherstrip member being positioned so as to sealingly and parallely contact a face of the door when the door is closed.

In an embodiment, the retaining member defines the door seal.

In an embodiment, the retaining member cross-sectionally defines an S-shaped segment comprising a first loop forming the retaining channel and a second loop frictionally engaging the jamb. A tail end of the second loop of the S-shaped segment can define a jamb-covering wall extending along an outer portion of the jamb. The retaining member can further define a branching segment projecting from the second loop away from the jamb, the door seal extending from the branching segment.

In an embodiment, the door seal of the retaining member defines a lip protruding away from the jamb at an angle with respect to a plane of the jamb.

In an embodiment, the door seal is made of a surface conforming material. The door seal and the remainder of the retaining member can be co-extruded and the material of the door seal can be more flexible than a material of a remainder of the retaining member.

In an embodiment, the retaining member comprises inner ribs projecting within the retaining channel, and the weatherstrip member comprises tabs protruding from the anchor portion engaging the inner ribs of the retaining member.

In an embodiment, the retaining member further comprises a pair of jamb seals respectively projecting from opposite extremities of the retaining member and sealingly contacting the jamb.

In an embodiment, the retaining member further comprises a pair of jamb seals respectively projecting from an inward extremity of the first loop of the S-shaped segment and an outward extremity of the jamb-covering wall, the jamb seals sealingly contacting the jamb.

In an embodiment, the jamb weatherstripping assembly further comprises an elongated cap secured to the retaining member in a spaced-apart arrangement, the retaining member and the cap jointly form a shielding chamber along the jamb. The door seal can be mounted to the elongaged cap. The cap can comprise a seal retaining channel and the door seal can comprise an anchor portion insertable in the seal retaining channel and a weatherstrip portion extending outwardly from the seal retaining channel when the anchor portion is inserted therein. The weatherstrip portion can be annular shaped and compressible.

In an embodiment, the retaining member is shorter than a length of the jamb, with a lower section of the jamb being uncovered by the retaining member.

According to another general aspect, there is provided a retaining member and elongated cap assembly affixable to a jamb of a doorframe supporting a hinged door and for use with an elongated weatherstrip member having an anchor portion and a weatherstrip portion longitudinally co-extending with the anchor portion. The retaining member and elongated cap assembly comprises: an elongated retaining member defining a retaining channel configured to engage and retain the anchor portion of the weatherstrip member; an elongated cap securable to the retaining member in a spaced-apart arrangement, the retaining member and the cap configured to jointly form a shielding chamber along an outer portion of the jamb when affixed thereto; and a door seal mounted to one of the elongated retaining member and the elongated cap and longitudinally co-extending with the retaining channel, the door seal being configured to sealingly contact, in use, a face of the door parallely to the weatherstrip portion of the weatherstrip member when the door is closed.

In an embodiment, the retaining member cross-sectionally defines an S-shaped segment comprising a first loop forming the retaining channel and a second loop configured for frictionally engage the jamb. A tail end of the second loop of the S-shaped segment can define a jamb-covering wall configured for extending along an outer portion of the jamb. The retaining member and elongated cap assembly can further define a branching segment projecting from the second loop away from the jamb when in use, the door seal extending from the branching segment.

In an embodiment, the door seal defines a lip protruding away from the jamb, when in use, at an angle with respect to a plane of the jamb.

In an embodiment, the door seal is made of a material less rigid than a material of a remainder of the retaining member and elongated cap assembly. The door seal and the remainder of the retaining member can be integrally molded.

The retaining member and elongated cap assembly can comprise inner ribs projecting within the retaining channel and configured to engage tabs protruding from the anchor portion of the weatherstrip member.

The retaining member and elongated cap assembly can further comprise a pair of jamb seals respectively projecting from opposite extremities of the retaining member and configured for sealingly contacting the jamb. The retaining member and elongated cap assembly can further comprise a pair of jamb seals respectively projecting from an inward extremity of the first loop of the S-shaped segment and an outward extremity of the jamb-covering wall, the jamb seals being configured for sealingly contacting the jamb.

In an embodiment, the elongated cap is shorter than a length of the jamb.

According to still another general aspect, there is provided a jamb weatherstripping kit for a jamb of a doorframe supporting a hinged door and for use with an elongated weatherstrip member defining an anchor portion and a weatherstrip portion longitudinally co-extending with the anchor portion. The jamb weatherstripping kit comprises: an elongated retaining member affixable to the jamb, the retaining member defining a retaining channel configured to engage and retain the anchor portion of the weatherstrip member; and an elongated cap securable to the retaining member in a spaced-apart arrangement, the retaining member and the cap configured to jointly form a shielding chamber along an outer portion of the jamb when affixed thereto.

In an embodiment, the shielding chamber is divided into an outward and an inward section.

In an embodiment, the retaining member cross-sectionally defines a substantially S-shaped segment comprising a first loop forming the retaining channel and a second loop configured for frictionally engaging the jamb. A tail end of the second loop of the S-shaped segment can define a jamb-covering wall configured for extending along an outer portion of the jamb and bounding the shielding chamber therealong. The jamb weatherstripping kit can further define a branching segment projecting from the second loop away from the jamb when in use. The retaining member can further define a door seal longitudinally co-extending with the retaining channel, the door seal being configured to sealingly contact, in use, a face of the door parallely to the weatherstrip portion of the weatherstrip member when the door is closed, the door seal extending from the branching segment. The cap can comprise a shielding wall extending in parallel with the jamb-covering wall of the retaining member when the cap is secured to the retaining member and bounding the shielding chamber. The branching segment can have a hook-shaped portion, and the cap can comprise a complementary hook-shaped projection transversally projecting from the shielding wall and engageable with the hook-shaped portion of the branching segment of the retaining member. The cap and the retaining member can further comprise complementary connectors respectively projecting transversally from the jamb-covering wall of the retaining member and the shielding wall of the cap, and engageable with each other. The complementary connectors can be snap fit connectors. The shielding wall of the cap can project further outwardly of the door than the jamb-covering wall of the retaining member when the cap is secured to the retaining member, the cap can further comprise a foot segment projecting transversally from the shielding wall and configured to contact the jamb outwardly of the retaining member. The cap can comprise a cap jamb seal projecting from an extremity of the foot segment of the cap and configured for sealingly contacting the jamb.

In an embodiment, the jamb weatherstripping assembly further comprises a pair of jamb seals respectively projecting from an inward extremity of the first loop of the S-shaped segment and an outward extremity of the jamb-covering wall, the jamb seals being configured for sealingly contacting the jamb.

The shielding chamber can be divided into: an inward section between the branching segment of the retaining member and the complementary connectors; and an outward section between the complementary connectors and the foot segment of the cap.

In an embodiment, the cap and the retaining member are shorter than a length of the jamb, with a lower section of the jamb being uncovered by the retaining member and the cap.

According to a further general aspect, there is provided a sweep device for a sill of a doorframe supporting a hinged door. The sweep device comprises: a U-shaped body formed of indoor, bottom and outdoor walls defining therebetween a channel sized to receive therein a bottom edge of a door slab of the door; at least one deflector projecting downwardly from the bottom wall of the U-shaped body; and first and second side channel seals projecting downwardly inside the channel from the indoor and outdoor walls, respectively, and configured to sealingly engage respective one of opposite side surfaces of the door slab.

In an embodiment, at least one of the first and second side channel seals extends from an upped edge of the corresponding one of the indoor and outdoor walls of the U-shaped body.

In an embodiment, the sweep device further comprises a pair of bottom channel seals projecting upwardly within the channel from the bottom wall of the U-shaped body and respectively pointing towards the indoor and outdoor walls.

According to a further general aspect, there is provided a door sill assembly comprising: a sill approach member having an upper surface and an outwardly extending interlock hook extending above the upper surface; and a sill threshold member connectable to the sill approach member and comprising a step portion and an outer supporting leg extending downwardly from the step portion, the outer supporting leg having a lower end abutting the upper surface of the sill approach member when connected thereto and including an inwardly extending interlock hook engageable with the outwardly extending interlock hook of the sill approach member when connected thereto, each one of the lower end of the outer supporting leg and the inwardly extending interlock hook comprising a seal member extending along a length of the sill threshold member and sealingly engaging a respective one of the upper surface of the sill approach member and the outwardly extending interlock hook of the sill approach member when connected thereto.

In an embodiment, the sill approach member comprises a sloping portion and an inner supporting leg supporting the sloping portion, the inner supporting leg having a section extending above the upper surface of the sill approach member and including the outwardly extending interlock hook. The door sill assembly can further comprise a sill structure having an outer portion and an inner portion, the sill approach member covering and being supported by the outer portion of the sill structure and the sill threshold member covering and being supported by the inner portion of the sill structure, the inner supporting leg of the sill approach member abutting an upper surface of the sill structure, the sill threshold member being connected to and supported by the sill structure, and the outer supporting leg of the sill threshold member extending outwardly of the inner supporting leg of the sill approach member.

In an embodiment, the inwardly extending interlock hook of the sill threshold member extends below the outwardly extending interlock hook of the sill approach member when engaged together.

In an embodiment, the sill threshold member is made by plastic co-extrusion with the seal members being made of a flexible plastic and a remaining portion of the sill threshold member being made of a rigid plastic.

According to another general aspect, there is provided a jamb weatherstripping assembly for a jamb of a doorframe supporting a hinged door. The jamb weatherstripping assembly comprises: an elongated retaining member affixed to the jamb, the retaining member defining a retaining channel engaging and retaining an anchor portion of a weatherstrip member and comprising a pair of jamb seals respectively projecting from opposite extremities of the retaining member and sealingly contacting the jamb.

In an embodiment, the retaining member cross-sectionally defines an S-shaped segment comprising a first loop forming the retaining channel and a second loop frictionally engaging the jamb. A tail end of the second loop of the S-shaped segment can define a jamb-covering wall extending along an outer portion of the jamb.

In an embodiment, the retaining member further defines a branching segment projecting from the second loop away from the jamb, the retaining member further comprise a door seal extending from the branching segment.

A first one of the pair of jamb seals can project from an inward extremity of the first loop of the S-shaped segment and a second one of the pair of jamb seals can projects from an outward extremity of the jamb-covering wall.

Other features and advantages of the invention will be better understood upon reading of embodiments thereof with reference to the appended drawings.

BRIEF DESCRIPTION OF THE DRAWINGS

FIG. 7 is a side view of a door sill provided with a door sill assembly according to one embodiment and FIG. 7A is an enlarged side view of a sill threshold member of the door sill shown in FIG. 7;

DETAILED DESCRIPTION OF THE PREFERRED EMBODIMENTS

Figure 1:
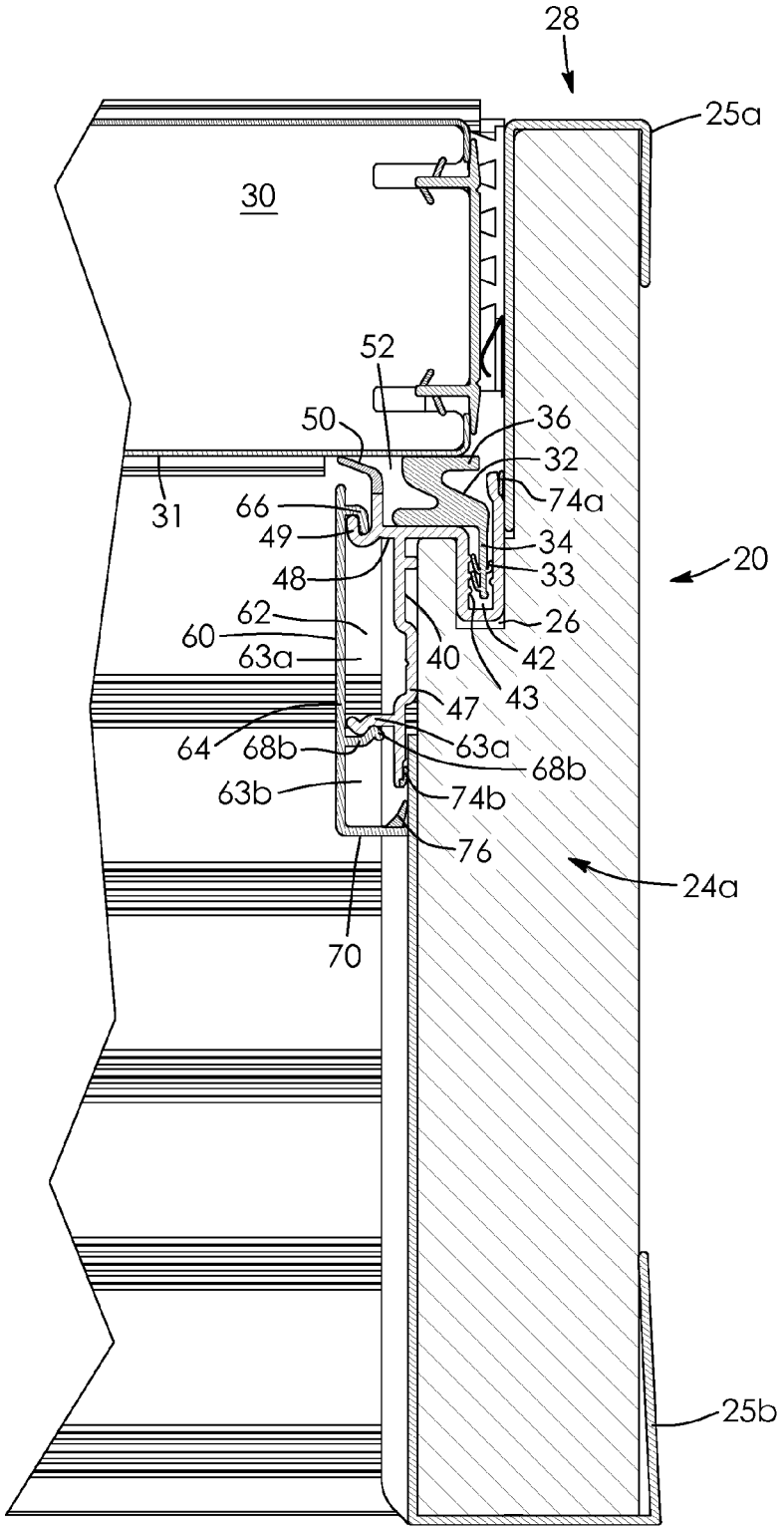
FIG. 1 is a cross-sectional view from the top of the lock side of a threshold provided with a jamb weatherstripping assembly according to one embodiment.

Although the embodiments of the door jamb and sill assemblies and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the door jamb and sill assemblies, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Referring to FIGS. 1 to 4, there is shown a jamb weatherstripping assembly 20 in accordance with one aspect. The jamb weatherstripping assembly 20 is shown affixed to a jamb 24 of a doorframe 28 supporting a hinged door 30. In some implementations, the doorframe 28 may be an entrance to a residential dwelling, a commercial building, an industrial building or other types of constructions. The hinged door 30 may be embodied by various types of doors which are operatively attached to the jamb 24 by hinges 29 (see FIG. 3). Typically, the hinged door 30 pivotally opens towards the interior of the building, although the door 30 could pivot toward the exterior as well. The door 30 can be made of any appropriate material or combinations thereof such as wood, metals, foam core, glass, or the like.

In some variants, as well known in the art, the jamb 24 has a wood-based core and may be provided with one or more jamb liners 25 shielding and protecting a surface of the jamb 24. In the illustrated embodiment, an indoor jamb liner 25*a* is shown covering a substantial portion of the jamb 24 that extends inside the building, whereas an outdoor jamb liner 25*b* covers a substantial portion of the jamb 24 outside of the building. In other implementations the hinge jamb 24 can be free of jamb liner. For the purpose of the present description, it will be understood that the jamb liners 25, when present, can be considered as forming a part of the jamb itself, and that various component of the weatherstrip assembly described here said to contact the jamb are in physical contact with the jamb liner if present.

Figure 2:
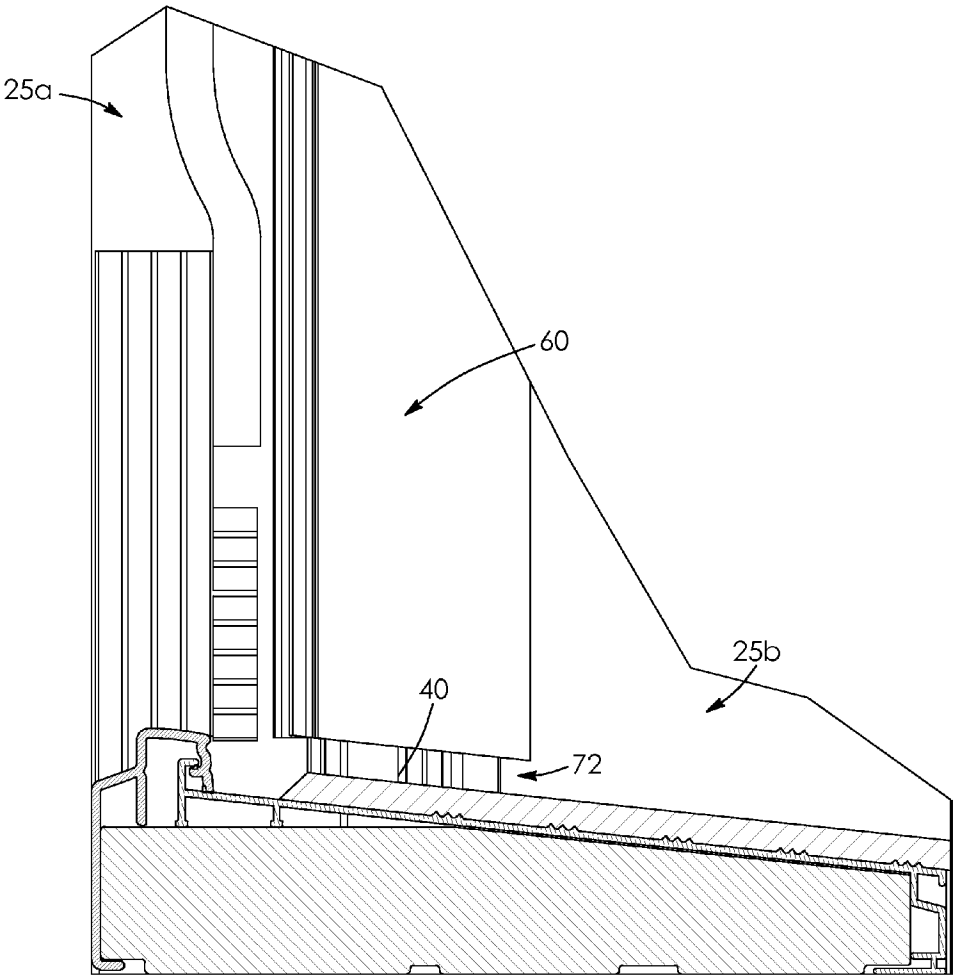
FIG. 2 is a side view of the lock-side door jamb of the threshold of FIG. 1.
Figure 3:
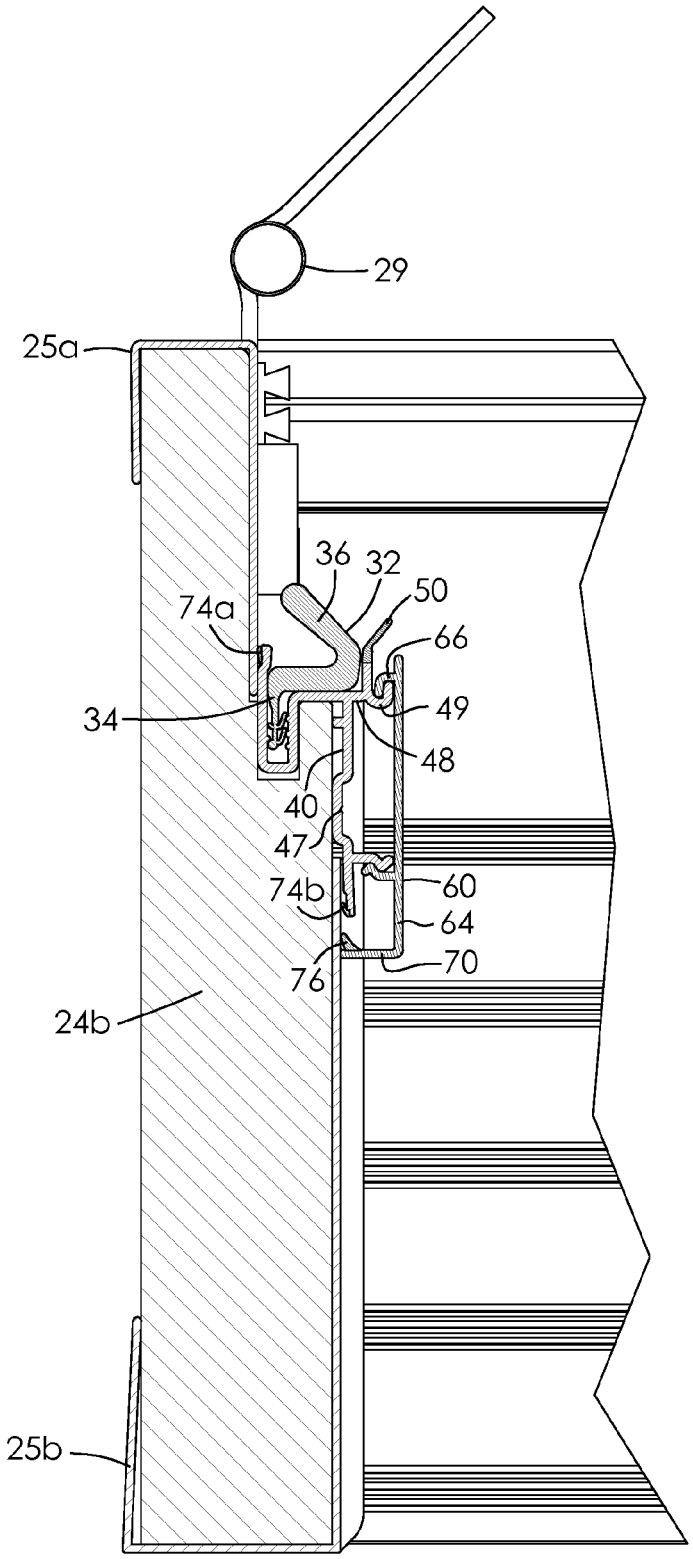
FIG. 3 is a cross-sectional view from the top of the hinge side of a threshold provided with a jamb weatherstripping assembly according to one embodiment.
Figure 4:
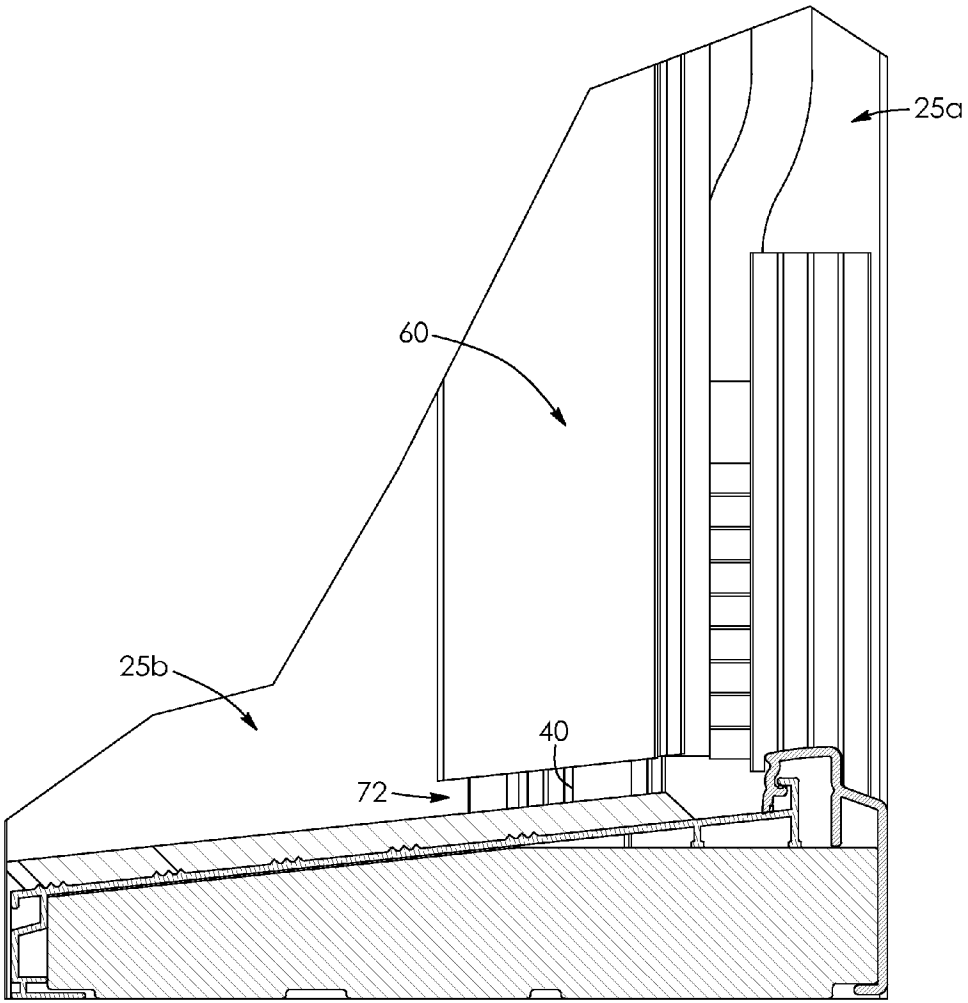
FIG. 4 is a side view of the hinge-side door jamb of the threshold of FIG. 3.

In the illustrated example of FIGS. 1 and 2, the jamb weatherstripping assembly 20 is provided along a lock jamb 24*a*, on the handle side of the door 30. FIGS. 3 and 4 shows a similar construction provided on the hinged jamb 24*b* of the door 30. In other variants (not shown), the jamb weatherstripping assembly may be provided along the head jamb of a door.

The jamb weatherstripping assembly 20 first includes an elongated weatherstrip member 32. Referring more particularly to FIGS. 1 and 3, the weatherstrip member 32 defines an anchor portion 34 and a weatherstrip portion 36 that longitudinally co-extends with the anchor portion 34. The anchor portion may serve to affix the weatherstrip member 32 to the corresponding jamb 24. As it will be apparent to one of ordinary skill in the art, when in use the weatherstrip portion 36 may project towards the door 30, so that upon closure of the door 30 within the doorframe 28, the weatherstrip portion 36 is compressed between the jamb 24 and the door 30, thereby providing a substantially air-tight seal therebetween.

In some implementations, the weatherstrip member 40 may be of a magnetic type, that is, may include an elongated magnet provided on or within the weatherstrip portion 36. The elongated magnet can bias the weatherstrip portion 36 towards the door 30 if the door 30 is made of or includes a magnetically-attractive material, such as a metal or the like, and thereby can improve the sealing interface between the weatherstrip portion 36 and the door 30. In the illustrated embodiment, the weatherstrip member 32 of FIG. 1 installed along the lock-side jamb 24*a* is shown as a magnetic weatherstrip, whereas the weatherstrip member 32 shown in FIG. 3, thereby installed on the hinge-side jamb 24*b*, is of a non-magnetic compression type.

The weatherstrip member 32 may be of typical constructions known in the art. Portions or the entirety of the weatherstrip member 32 can be made of any suitable flexible, compressible, and/or resilient material, such as for example flexible plastic or rubber, silicone, foam rubber, fiberglass, synthetic foam material, gels, or the like.

Still referring more particularly to FIGS. 1 and 3, the jamb weatherstripping assembly 20 further includes an elongated retaining member 40. The retaining member 40 is affixed to the jamb 24 along its length. In an implementation, the retaining member 40 extends along an entire length of the jamb 24. In another implementation, the retaining member 40 extends along a partial length of the jamb 24, being slightly shorter and spaced-apart from the sill 102.

In one implementation, the retaining member 40 is shaped to match or follow more or less closely the shape of the section of the jamb 24 to which it is affixed that extends outdoors, that is, exposed to the outside of the building. In accordance with various aspects and implementations, the retaining member 40 may provide additional protection and insulation of the jamb and surrounding space and also serve to retain the weatherstrip member 32 in position.

More particularly, in the embodiment shown, the retaining member 40 extends between the indoor jamb liner 25*a* and the outdoor jamb liner 25*b* with end sections superposed to each one of the indoor jamb liner 25*a* and the outdoor jamb liner 25*b*, outwardly thereof. In the embodiment shown, the retaining member 40 provides protection to the jamb 24, in the section between the indoor jamb liner 25*a* and the outdoor jamb liner 25*b*.

In some embodiments, the retaining member 32 defines a retaining channel 42. The retaining channel may be sized and shape to fit snuggly within a recess 26 provided in the jamb 24 and facing towards the door 30. Typically, the anchor portion of prior art weatherstrips is adapted to be frictionally engaged directly within such a recess 26. In the present embodiment, the retaining channel 42 is inserted within the recess 26 and engages and retains the anchor portion 34 of the weatherstrip member 32 therein. This engagement may be provided in any appropriate fashion which allows the secure retention of the anchor portion 34 of the weatherstrip member 32 within the retaining channel 42 of the retaining member 40. In one example, the retaining member 40 may be provided with inner ribs 43 projecting within the retaining channel 42, and the weatherstrip member 32 may include tabs 33 protruding from the anchor portion 34 and engaging the inner ribs 43 of the retaining member 40. Of course, other types of engagements may be considered without departing from the scope of the present description.

The cross-section shape of an embodiment of the retaining member 40 will now be described with continued reference to FIGS. 1 and 3, and with additional reference to FIG. 5.

In the illustrated embodiment, the retaining member 40 cross-sectionally defines an S-shaped segment 44 which includes a first loop 45 and a second loop 46. The first loop forms the retaining channel 42, while the second loop 46 frictionally engages the jamb 24. As mentioned above, the retaining channel 42 may be provided with inner ribs 43 or equivalent structures for engaging the anchor portion of the weatherstrip. The tail end of the second loop 46 defines a jamb-covering wall 47 extending, in use, along an outer portion of the jamb 24. The length of the jamb-covering wall 47 may vary depending on the design of the retaining member 40 and the intended use of the weatherstrip assembly 20. Advantageously, the jamb-covering wall 47 may provide protection against the elements for a portion of the jamb 24 which is typically left unprotected, i.e. the portion extending inwardly from the end of the outdoor jamb liner 25*b*. A section of the jamb-covering wall 47 is outwardly superposed to an end section of the outdoor jamb liner 25*b* to provide a continuous protection to the jamb 24.

The S-shaped segment 44 of the retaining member 40 may be affixed to the jamb 24 in any suitable manner. In some implementations, a frictional engagement may be sufficient to retain the first and second loops 45 and 46 in position. Optionally, additional fixing components such as glue, caulking, nails, and the like may be used.

Figure 5:
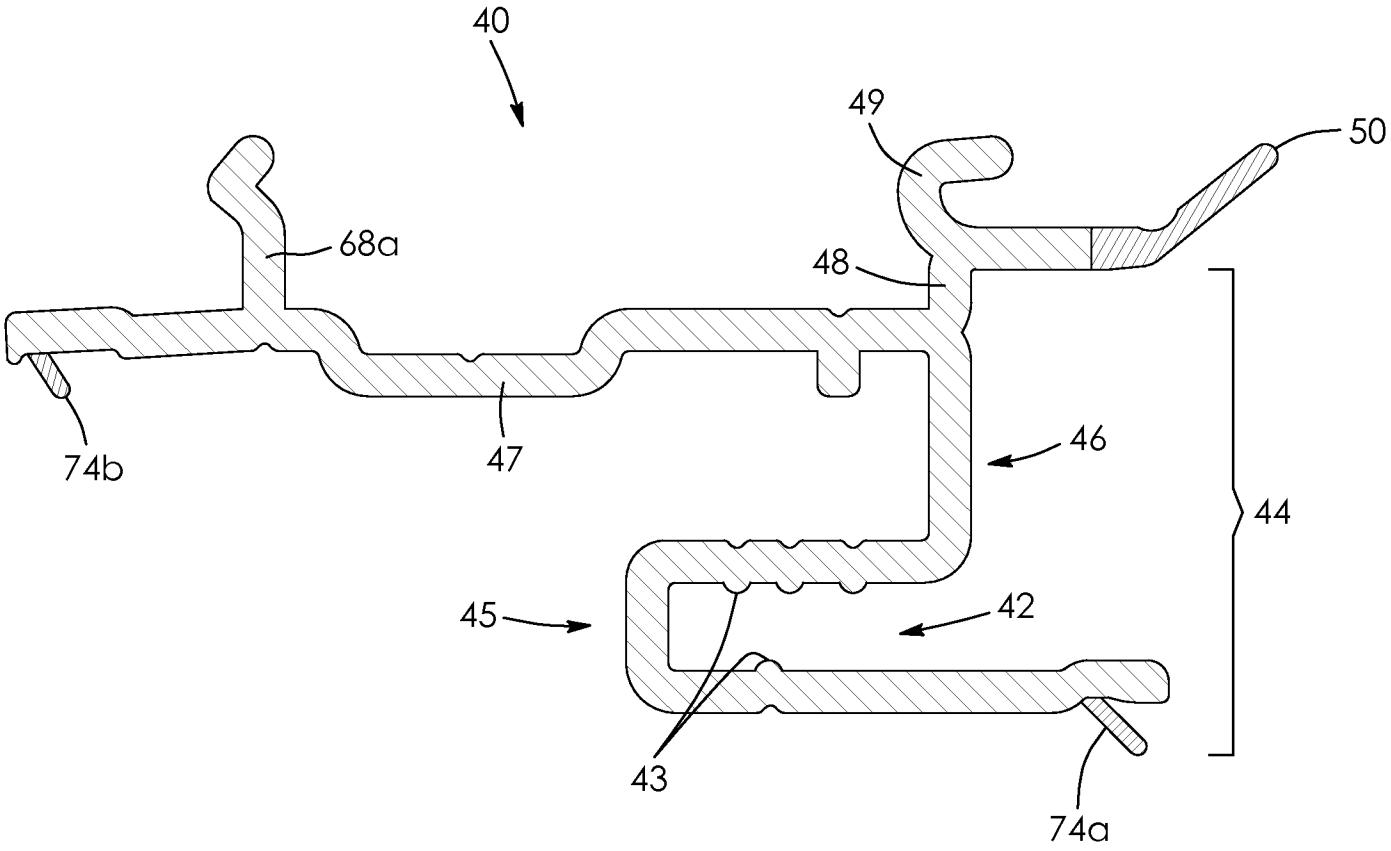
FIG. 5 is a schematized cross-sectional representation of a retaining member for a jamb weatherstripping assembly according to one embodiment.
Figure 6:
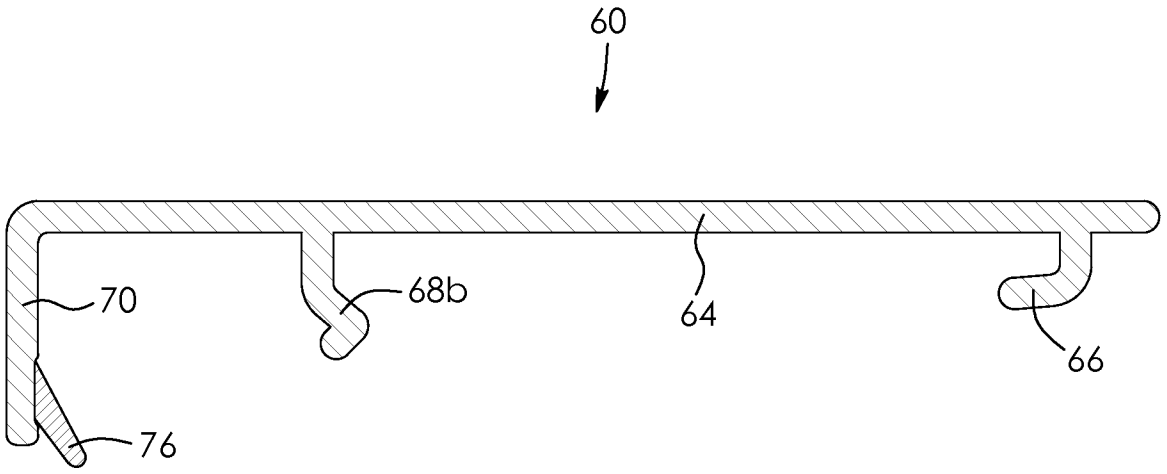
FIG. 6 is a schematized cross-sectional representation of a cap for use with the retaining member for a jamb weatherstripping assembly of FIG. 5.

Still referring to FIGS. 1, 3 and 5, in the illustrated implementation the retaining member 40 further defines a branching segment 48 branching out from the S-shaped segment 44. In the illustrated embodiment the branching segment 48 projects from a corner of the second loop 46, away from the jamb 24.

In accordance with one aspect, the retaining member 40 may further defines a door seal 50 longitudinally co-extending with the retaining channel 42. In the illustrated embodiment, the door seal 50 extends from the branching segment 48, but alternative configurations may be considered. In use, the door seal 50 of the retaining member 40 and the weatherstrip portion 36 of the weatherstrip member 32 are positioned so as to sealingly and parallely contact a face 31 of the door 30 when the door 30 is closed. Advantageously, this configuration may provide an additional insulation protecting the space between the door 30 and the jamb 24 from water infiltration and the like. Indeed, as will be readily understood by one skilled in the art, the double sealing action of the weatherstrip portion 36 and the door seal 50 not only provide two barriers to incoming water or air but may also create a low-pressure cavity 52 in which water will not be subjected to outside forces pushing it towards the weatherstrip members. Leaks through or around the weatherstrip portion created under the pressure of the elements may therefore be avoided or minimized.

In one implementation, the door seal of the retaining member may define a lip protruding away from the jamb 24 at an angle with respect to a plane of the jamb 24. Advantageously, in this embodiment the seal between the door face and the door seal is improved by avoiding the formation of an inward hollow which may otherwise result from the compression of the door seal against the door.

The retaining member 40 may be made of any suitable materials. In some embodiments, the S-shaped segment and the jamb covering wall may be made of extruded plastic such as and without being limitative rigid PVC. It can also be made of other suitable materials such as and without being limitative aluminium. The door seal 50 is made of a material less rigid than the material forming the S-shaped segment 44 and branching segment 48, i.e. a surface conforming material. For example, the door seal may be made of flexible PVC, rubber or other resilient material conforming to the face of the door to form a sealing engagement. In some implementation, the door seal 50 and the remainder of the retaining member 40 may be single piece, for example, they can manufacture with a co-extrusion process wherein rigid and flexible PVC are fused together.

Referring now to FIGS. 1 to 4 and 6, in accordance with one aspect the weatherstrip assembly 20 may further include an elongated cap 60. The cap 60 is secured to the retaining member 40 along the jamb-covering wall 47 in a spaced-apart arrangement. As best seen in FIGS. 1 and 3, the retaining member 40 and the cap 60 jointly form a shielding chamber 62 along the jamb 24.

In some implementations, the cap 60 may be made of the same suitable described above in reference to the retaining member. For instance and without being limitative, it can be made of extruded rigid PVC or aluminium. It can also be a co-extrusion of two different materials, as will be described in more details below.

In the illustrated embodiment, the cap 60 includes a shielding wall 64 extending substantially in parallel with the jamb-covering wall 47 of the retaining member 40 when the cap 60 is secured to the retaining member 40. The spaced-apart arrangement of the cap 60 and retaining member 40 is therefore defined by the substantially parallel configuration of the shielding wall 64 and the jamb-covering wall 47.

The cap 60 may be affixed to the retaining members 40 in any appropriate manner. Referring to FIGS. 1, 3, 5 and 6, in the illustrated implementation, the branching segment 48 of the retaining member 40 has a hook-shaped portion 49, and the cap 60 has a complementary hook-shaped projection 66 transversally projecting from the shielding wall 64, for example proximate an inward end of the shielding wall 64. In use, the hook-shaped projection 66 is therefore engaged with the hook-shaped portion 49 of the branching segment 48 of the retaining member 40. The cap 60 and the retaining member 40 may further include complementary connectors 68*a*, 68*b* respectively projecting transversally from the jamb-covering wall 47 of the retaining member 40 and the shielding wall 64 of the cap 60. The connectors 68*a*, 68*b* can be engageable with each other according to configurations known in the art, for example through a "snap-fit" connection. Such an embodiment can allow the cap 60 to be simply "clipped" in place on the retaining member 40 without the need for special tools or additional connectors. Other configurations are however possible. For example, in one possible implementation nails (not shown) may be driven through the cap and retaining member all to the way to the jamb to secure these components to each other and to the jamb more solidly.

In accordance with one implementation, the shielding wall 64 of the cap 60 may project further outwardly of the door 30 than the jamb-covering wall 47 of the retaining member 40 when the cap 60 is secured to the retaining member 40. This feature is best seen in FIGS. 1 and 3. In this variant, the cap 60 may further include a foot segment 70 projecting transversally from the shielding wall 64 and configured to contact the jamb 24 outwardly of the retaining member 40. In this implementation, the shielding chamber 62 is divided into two different sections, separated by the complementary connectors 68*a*, 68*b*: an inward section 63*a* close to the door 30 and an outward section 63*b* extending further away from the door 30. The inward section 63*a* is bound by a portion of the jamb-covering wall 47, the branching segment 48, a portion of the shielding wall 64 and the connectors 68*a*, 68*b*. The outward section 63*b* is bound by the connectors 68*a*, 68*b*, a portion of the shielding wall 64, the foot segment 70, the outward portion of the jamb-covering wall 47 and a contiguous part of the jamb 24 itself.

As will be readily understood by one skilled in the art, the shielding chamber 62 can provide additional protection of the jamb 24. Firstly, the jamb-covering wall 47 provides a screening layer protecting of the outward portion of the jamb 24 from the being exposed to wind, rain, and other weather conditions or damaging infiltrations. Secondly, the shielding chamber 62 creates a reduced-pressure zone which can prevent water and the like from reaching the jamb 24. Indeed, even if water comes to infiltrate the shielding chamber 62, under the reduced pressure condition it will tend to fall down towards the sill of the door threshold instead of being projected towards the jamb 24. Finally, the illustrated variant using a "double chamber sections" configuration provides two reduced pressure zones where water that would normally be projected towards the door 30 and the jamb 24 can be stopped before even reaching the door seal 50 and the weatherstrip member 32. This can further reduce infiltrations between the door 30 and the jamb 24.

Referring more particularly to FIGS. 2 and 4, in some embodiments, the cap 60 and the retaining member 40 may be shorter than the jamb 24, and may be installed on the jamb 24 so as to leave a free space between the door sill and the lower ends of the cap 60 and the retaining member 40. This configuration advantageously provides a water outlet 72 at the bottom of the shielding chamber 62, providing an escape route for water infiltrating the shielding chamber. As will be readily understood by one skilled in the art, this configuration prevents unwanted water accumulation within the weatherstrip assembly 20 itself. The lower end section of the jamb 24 may be covered with caulking material, such as silicone, as it is known in the art, to prevent water infiltration.

In another implementation, the cap 60 may be shorter than the retaining member 40 and the jamb 24 to which they are mounted, thereby leaving a free space between the door sill and the lower ends of the cap 60. As the above described configuration, this configuration provides a water outlet 72 at the bottom of the shielding chamber 62, providing an escape route for water infiltrating the shielding chamber.

In some embodiments, the retaining member 40 and the cap 60 may include additional seals to prevent water infiltration along their periphery. For example, in the illustrated embodiment of FIGS. 1 to 6, the retaining member 40 includes a pair of jamb seals 74*a*, 74*b* respectively projecting from the indoor extremity and the outdoor extremity of the retaining member 40. In the illustrated embodiment the jamb seals 74*a*, 74*b* respectively project from the inward extremity of the first loop 45 of the S-shaped segment 44 and the outward extremity of the jamb-covering wall 47. The jamb seals 74*a* projects inwardly towards, the door, and abuts the indoor jamb liner 25*a*. The jamb seals 74*b* also projects inwardly towards, the door, but abuts the outdoor jamb liner 25*b*. The jamb seals 74*a*, 74*b* sealingly contacting the jamb 24 and, more particularly, the jamb liners 25*a*, 25*b*, to avoid or minimize water infiltration between the retaining member 40 and the jamb 24. Similarly, the cap 60 may be provided with a cap jamb seal 76 projecting from an extremity of the foot segment 70 of the cap 60 and configured for sealingly contacting the jamb 24. The cap seal 76 and jamb seals 74*a*, 74*b* may be made of a relatively flexible material which conforms to the surface it contacts. For instance and without being limitative, the cap seal 76 and jamb seals 74*a*, 74*b* can be made of flexible PVC or other suitable surface conforming material. For instance, they can be co-extruded simultaneously with the cap 60 and the retaining member 40, respectively.

It will be readily understood that components of the weatherstrip assembly according to embodiments described herein and equivalents thereto may be provided separately or jointly. In one example, retaining members may be commercialized as standalone components designed to fit standard or generic doorframes, and adapted to cooperate with already available weatherstrip members. In other variants, a retaining member and matching cap may be provided as a jamb weatherstripping kit, which may or may not also include weatherstrip member.

The above-described weatherstrip assembly reduces the quantity of caulking material to be applied upon installation. Furthermore, components can be easily removed for replacement.

Figure 7:
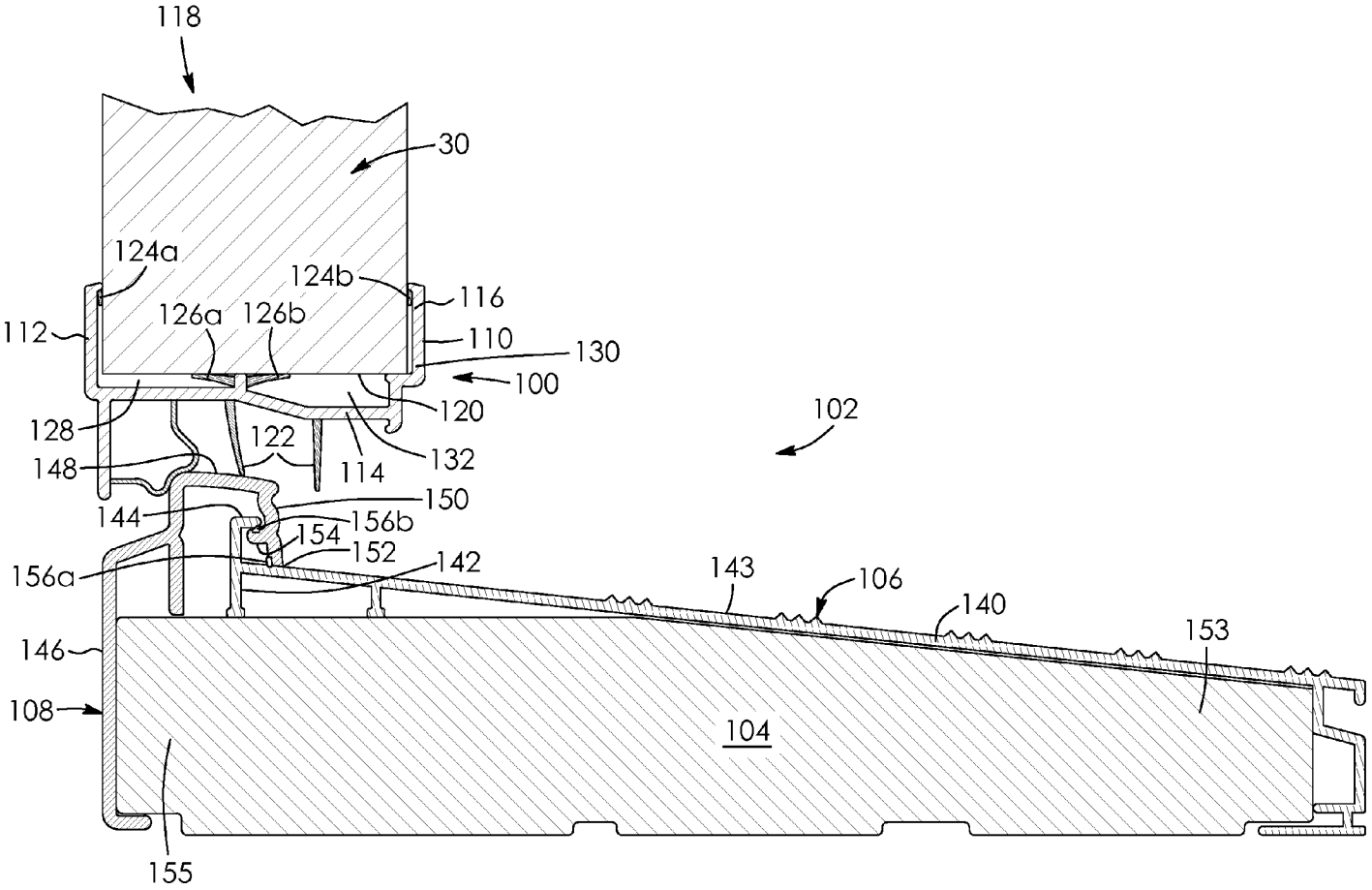
Figure 8:
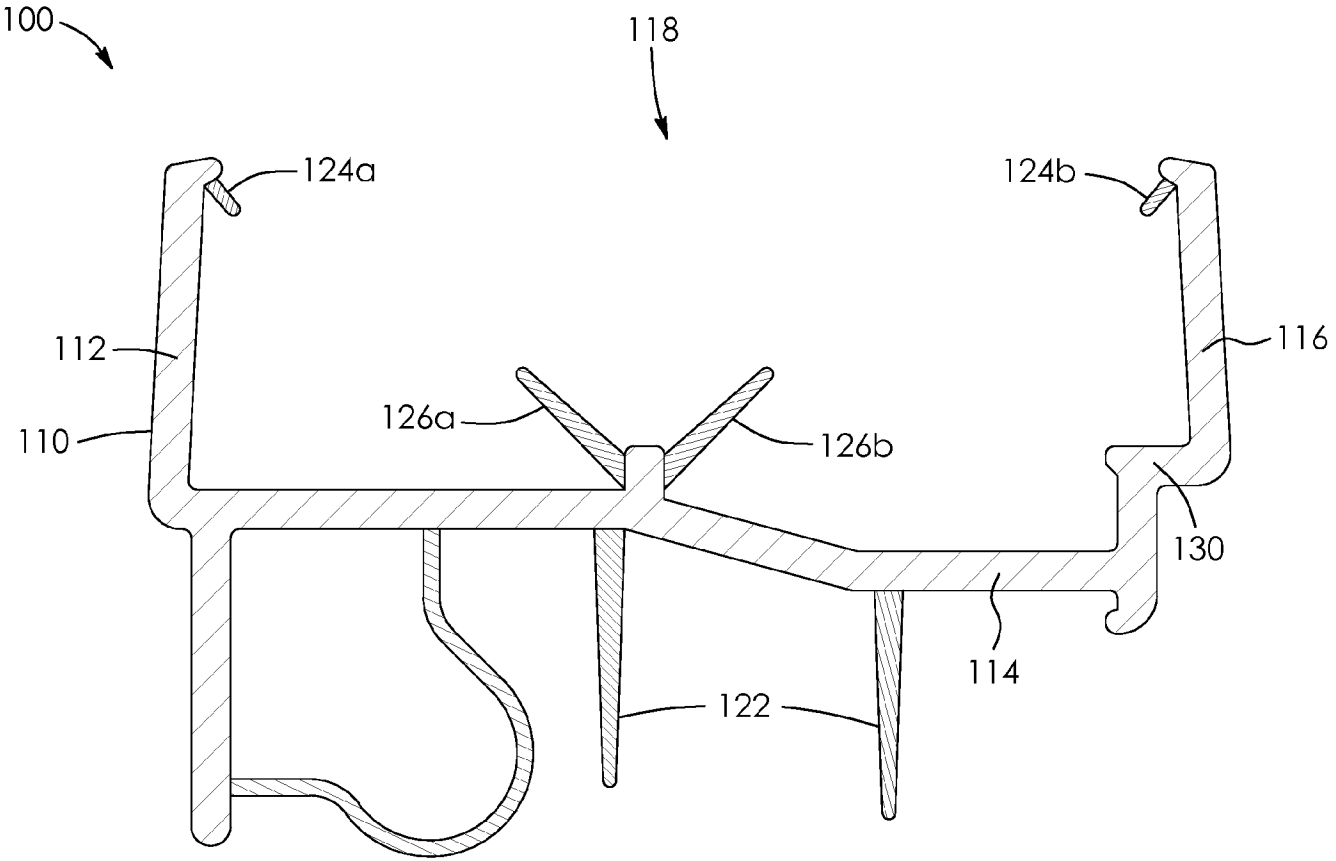
FIG. 8 is a schematized cross-sectional representation of a sweep device as used in the door sill assembly of FIG. 7.

Referring now to FIGS. 7 and 8, in accordance with another aspect there is also provided a sweep device 100 for a sill 102 of a doorframe 28 supporting a hinged door 30.

The entrance of a building such as described herein typically has a door sill 102 including an underlying sill structure 104, usually made of wood, covered with a sill approach member 106 typically embodied by a plate made of aluminum or other appropriate material and covering the sill structure 104. The sill structure 104 and sill approach member 106 are typically inclined towards the outside of the building, as this allows water hitting the sill to naturally slide away from the door. The entrance may also include a sill threshold member 108 having a structure adapted to prevent or minimize water infiltration along the bottom edge of the door.

The sweep device 100 according to the present aspect may be used, in collaboration with the sill threshold member 108, to protect the space at the bottom of the door. In the illustrated embodiment, the sweep device 100 includes a U-shaped body 110. The U-shaped body is formed of an indoor wall 112, a bottom wall 114 and an outdoor wall 116 which define therebetween a channel 118. The channel 118 is sized to receive the bottom edge 120 of a door slab of the door 30. In the embodiment shown, the U-shaped body 110 is designed to cover the full width of the door 30 or at least a substantial portion of the door width. In one embodiment, the U-shaped body 110 of the sweep device 100 may be made of a substantially rigid plastic such as and without being limitative, rigid PVC or aluminium.

The U-shaped body may be affixed to the bottom edge 120 of the door through a variety of suitable techniques. In some embodiment the U-shaped body 110 may frictionally engage the bottom edge of the door. Adhesives such as glue, a sealing compound or the like, as well as fasteners such as nails, screws and the like may alternatively or additionally be used.

One or more deflectors 122 project downwardly from the bottom wall 114 of the U-shaped body 110, and can extend along a full width or along most of the full width of the door 30. As is known in the art, such deflectors can be made of a flexible material allowing at least some measure of deflection, so that they can "sweep" the sill when the door is pivoted. In accordance with different variants, the number and construction of the deflectors may vary.

The engagement of the U-shaped body 110 with the door 30 may be a source of water infiltration. Water or other contaminants may accumulate at the bottom of the channel 118 and lead to damages to the 30 door or the sweep device 100. To address this issue, the door sweep 100 may include first and second side channel seals 124*a*, 124*b* projecting downwardly inside the channel 118 from the indoor and outdoor walls 112 and 116, respectively. The side channel seals 124*a*, 124*b* are configured to sealingly engage the opposed side walls of the door slab, close to the bottom edge 120. Because they are downwardly oriented, the engagement of the U-shaped body 110 with the door 30 is relatively easy but they provide resistance to disengagement. In the illustrated variant, each side channel seal 124, 124*b* extends from the upped edge of the corresponding walls 112, 116 of the U-shaped body 110, such that accumulation between the corresponding wall and the adjacent surface of the door slab is avoided or limited.

In one implementation, the sweep device 100 further includes one or more channel seals 126 projecting upwardly within the channel 118 from the bottom wall 114 of the U-shaped body 110. In the illustrated embodiment a pair of such bottom channel seals 126*a*, 126*b* is provided, respectively pointing towards the indoor wall 112 and the outdoor wall 116. Upon installation, a caulking material can be applied at the junction of the bottom channel seals 126*a*, 126*b*.

The side channel seal and bottom channel seal can be made of a surface conforming material such as and without being limitative flexible PVC and rubber. In some implementation, the side channel seal and bottom channel seal can be single piece with the U-shaped body 110. For instance, they can manufacture with a co-extrusion process wherein rigid and flexible PVC are fused together.

In the illustrated embodiment the outdoor wall 116 of the U-shaped body 110 defines a shoulder on which the bottom edge 120 of the door slab 130 is supported. Such a configuration leaves a free space 132 between the bottom edge of the door slab 130 and the bottom wall 114 of the U-shaped body 110. The bottom wall 114 of the U-shaped body 110 can be provided with spaced-apart through holes (not shown) in fluid communication with the free space 132 and through which water that infiltrates between the door and the U-shaped body 110 can flow outwardly. In the illustrated embodiment a sealant 128 is provided along the indoor side of the free space 132 to prevent water accumulation therein.

Referring back to FIG. 7, there is shown that the sill approach member 106 has a sloping portion 140 supported by an inner supporting leg 142, at a connection with the sill threshold member 108. The sloping portion 140 defines an upper surface 143 of the sill approach member. The inner supporting leg 142 extends downwardly from the sloping portion 140 and is supported by the sill structure 104. The inner supporting leg 142 of the sill approach member 106 includes a section extending above the upper surface 143 and including an outwardly extending interlock hook 144.

The outwardly extending interlock hook 144 is designed to engage an interlock hook of the sill threshold member 108, as will be described in more details below.

The sill threshold member 108 is supported and connected to the sill approach member 106 and the sill structure 104. The sill threshold member 108 comprises a substantially C-shaped hook portion 146 in an interior portion thereof engaging an inner end of the sill structure 104. It also includes a step portion 148 and an outer supporting leg 150 extending downwardly from the step portion 148, at an outer portion thereof. The outer supporting leg 150 is supported by the sill structure 104. More particularly, a lower end 152 of the outer supporting leg 150 abuts the sloping portion 140, proximate to the inner supporting leg 142. It extends outwardly of the inner supporting leg 142 and has an inwardly extending interlock hook 154 engaged with the outwardly extending interlock hook 144 of the sill approach member 106. More particularly, the inwardly extending interlock hook 154 is engaged under the outwardly extending interlock hook 144. The outer supporting leg 150 extends outwardly of the inner supporting leg 142 and, more particularly, the section extending above the upper surface 143.

The sill structure 104 can be divided into an outer portion 153, covered by the sill approach member 106 and supporting same, and an inner portion 155, covered by the sill threshold member 108 and supporting same.

Each one of the lower end 152 of the outer supporting leg 150 and the inwardly extending interlock hook 154 comprises a seal member 156*a*, 156*b*. The outer supporting leg 150, the outwardly extending interlock hook 144, the inwardly extending interlock hook 154, and the seal member 156*a*, 156*b* extend the width of the sill approach member 106 and form a substantially airtight and watertight joint. The seal members 156*a*, 156*b* sealingly engage a respective one of the upper surface 143 of the sill approach member 106 and the outwardly extending interlock hook 144 of the sill approach member 106 when connected thereto.

The seal members 156*a*, 156*b* are made of a material which substantially conforms to the surface against which it is abutted. For instance and without being limitative, the sill threshold member 108, excluding the seal members 156*a*, 156*b*, can be made of rigid plastic such as rigid PVC. The seal members 156*a*, 156*b* are made of a flexible plastic to conform to the surfaces against which they are abutted, such as flexible PVC. They can be co-extruded as a single piece. The flexibility of the seal members 156*a*, 156*b* provides a substantially airtight and watertight joint between the sill approach member 106 and the sill threshold member 108. Seal member 156*b* prevents water infiltration between the sill approach member 106 and the sill threshold member 108 in case of deficiency of seal member 156*a*. It further ensures that the sill threshold member 108 is pressed and firmly maintain against the sill approach member 106. By having two seal members 156*a*, 156*b* extending along a length of the sill threshold member 108, the dimensional tolerance of the sill approach member 106 and the sill threshold member 108 is increased for maintaining a substantially airtight and watertight joint in between.

Figure 9:
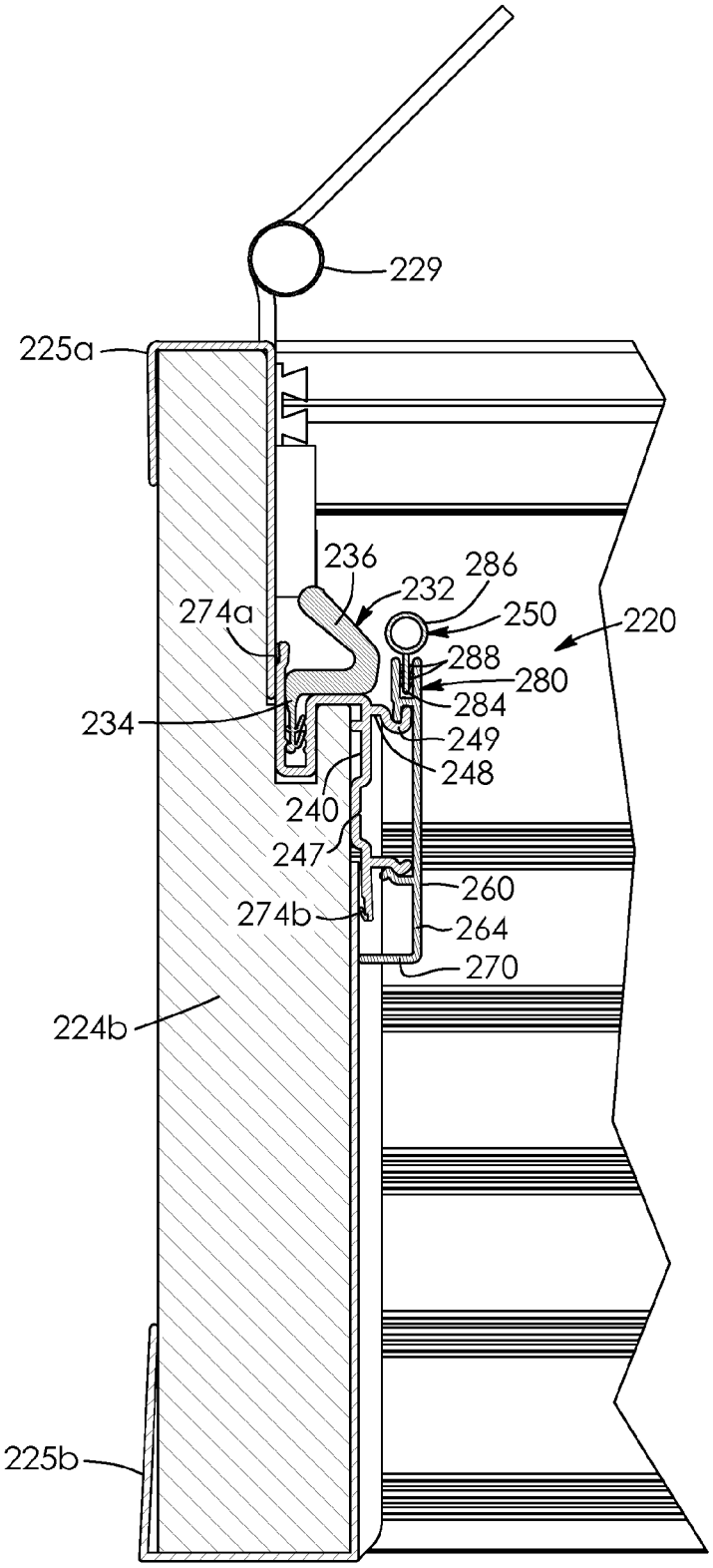
FIG. 9 is a cross-sectional view from the top of the hinge side of a threshold provided with a jamb weatherstripping assembly according to another embodiment, wherein a door seal is provided on the cap.
Figure 10:
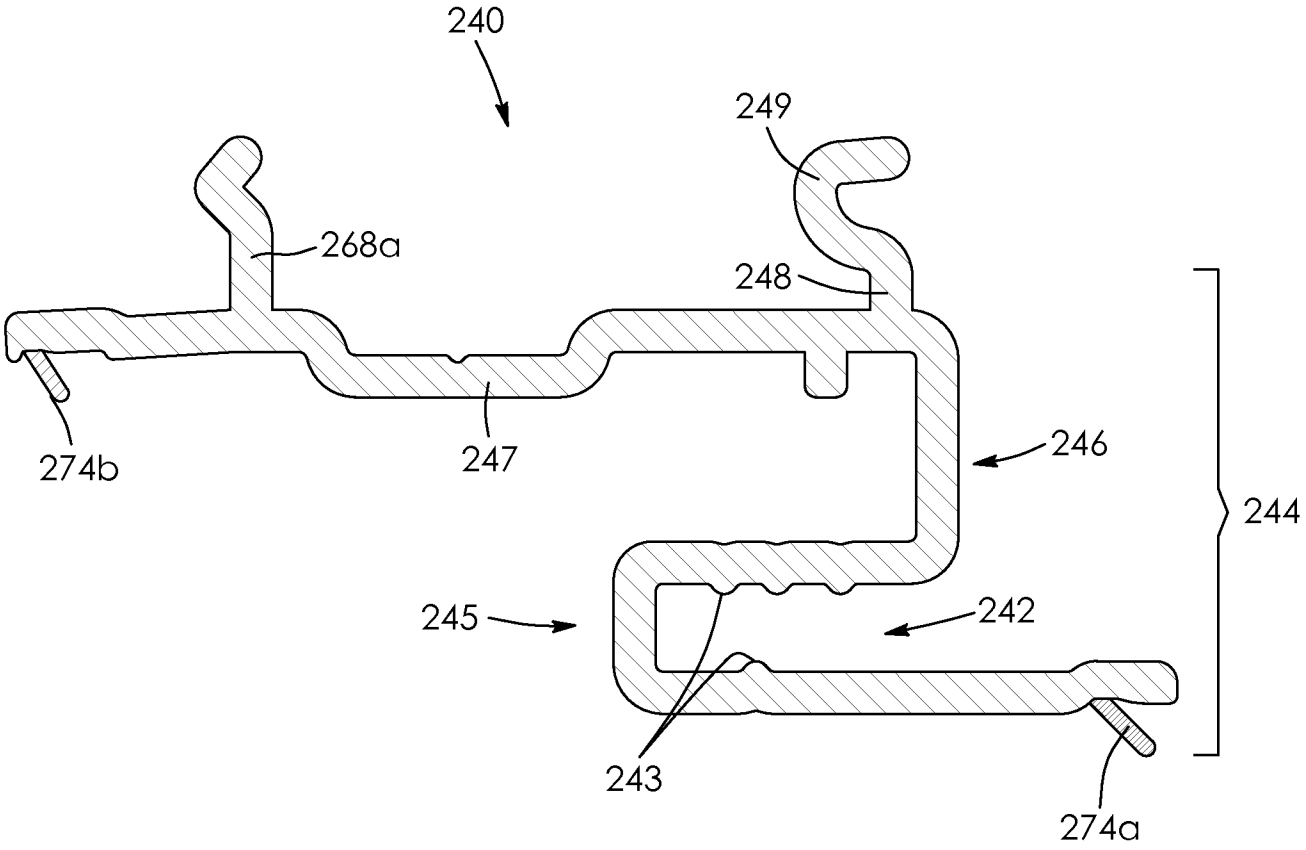
FIG. 10 is a schematized cross-sectional representation of the retaining member for the jamb weatherstripping assembly shown in FIG. 9.
Figure 11:
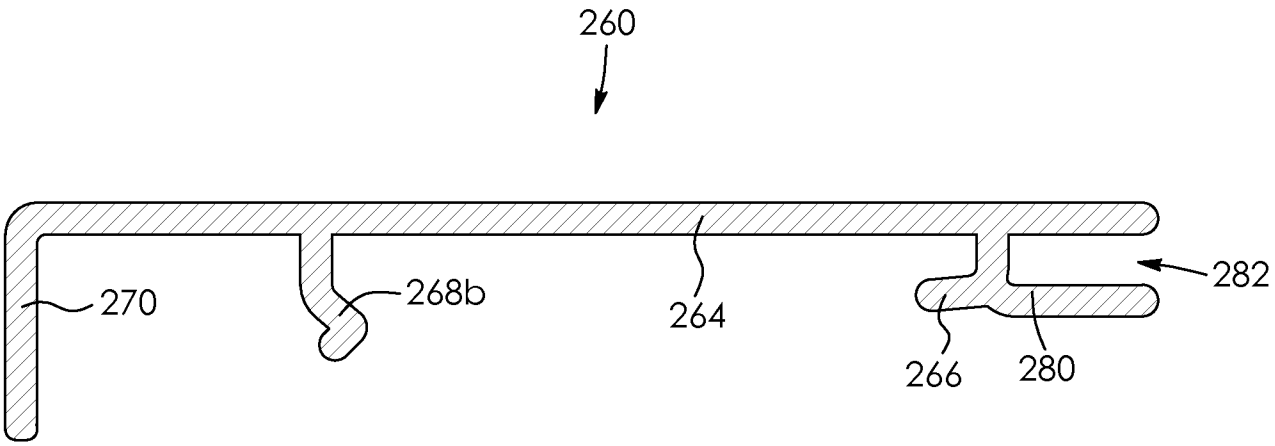
FIG. 11 is a schematized cross-sectional representation of a cap for use with the retaining member for the jamb weatherstripping assembly of FIG. 9.

Referring now to FIGS. 9 to 11, there is shown an alternative embodiment of the jamb weatherstripping assembly 220 wherein the features are numbered with reference numerals in the 200 series which correspond to the reference numerals of the previous embodiment. The jamb weatherstripping assembly 220 is substantially similar to the jamb weatherstripping assembly 220 described above in reference to FIGS. 1 to 6, except that the seal member 250 is engaged with the cap 260 instead of the retaining member 40. Furthermore, the shape of the seal member 250 differs from seal member 50.

In the embodiment shown, the jamb weatherstripping assembly 220 for the hinged jamb 224*b* is shown. It is appreciated that a similar jamb weatherstripping assembly 220 can be provided along the lock jamb 224*a* and the head jamb.

Furthermore, the jamb weatherstripping assembly 220 is shown with a weatherstrip member 232 a non-magnetic compression type weatherstrip member but it is appreciated that it can also be used with a magnetic type weatherstrip member.

In reference to FIGS. 9 and 10, there is shown that the elongated retaining member 240 is substantially similar to the retaining member 40, except that it does not include a door seal 50 extending from the branching segment 248, at a junction of the branching segment 248 and the S-shaped segment 244. The cap 260 is engaged with the retaining member 240 as will be described in more details below.

Referring now to FIGS. 9 and 11, there is shown that the cap 260 is also substantially similar to the cap 60, except that it includes the door seal 250. As the cap 60, the cap 260 is secured to the retaining member 240 along the jamb-covering wall 247 in a spaced-apart arrangement.

The cap 260 includes a U-shaped extension 280 extending inwardly from the shielding wall 264 and the hook-shaped projection 266. The U-shaped extension 280 defines a seal retaining channel 282 opened towards the door (or the inside of the building). The door seal 250 differs in shape from the door seal 50. It includes an anchor portion 284 and a weatherstrip portion 286 that longitudinally co-extends with the anchor portion 284. The anchor portion 284 is insertable in the seal retaining channel 282 to engage the door seal 250 with the cap 260. As it will be apparent to one of ordinary skill in the art, when in use the weatherstrip portion 286 projects towards the door, so that upon closure of the door within the doorframe, the weatherstrip portion 286 is compressed against the door, thereby providing a substantially air-tight seal therebetween.

The anchor portion 284 is insertable in the seal retaining channel 282 and frictionally engageable with the U-shaped extension 280. In the embodiment shown, the anchor portion 284 includes protruding tabs 288 engaging the inner walls of the U-shaped extension 280. The protruding tabs 288 are oriented towards the door (or the inside of the building), to secure retention of the anchor portion 284 of the door seal 250 within the seal retaining channel 282 and prevent easy disengagement between the door seal 250 and the cap 260. Other types of engagements may be considered without departing from the scope of the present description.

In the embodiment shown, the weatherstrip portion 286 is substantially annular in shape and compressible by the door. It extends at the inner end of the door seal 250 when the anchor portion 284 is inserted in the seal retaining channel 282.

The length of the anchor portion 284 inserted in the seal retaining channel 282 can be manually adjusted to ensure that the weatherstrip portion 286 abuts against the door when the door is configured in the closed configuration.

The door seal 250 longitudinally co-extends with the cap 260. In an alternative embodiment, it could extend from the retaining member 240. In the illustrated embodiment, the door seal 250 is removably engaged with the cap 260. However, it is appreciated that, in an alternative embodiment, it can be single piece with either the cap 260 or the retaining member 240.

In use, the door seal 250 and the weatherstrip portion 236 of the weatherstrip member 232 are positioned so as to sealingly and parallely contact a face of the door when the door is closed. Advantageously, as for the above described embodiment, this configuration may provide an additional insulation protecting the space between the door and the jamb 224 from water infiltration and the like. Indeed, as will be readily understood by one skilled in the art, the double sealing action of the weatherstrip portion 236 and the door seal 250 not only provide two barriers to incoming water or air but may also create a low-pressure cavity 252 in which water will not be subjected to outside forces pushing it towards the weatherstrip members. Leaks through or around the weatherstrip portion created under the pressure of the elements may therefore be avoided or minimized.

The door seal 250 may be single piece made of surface conforming material such as and without being limitative flexible PVC. In an alternative embodiment, the anchor portion 284 can be made of rigid PVC while the tabs 288 and the weatherstrip portion 286 can be made of flexible PVC. In this embodiment, the door seal 250 can be co-extruded as a single piece.

Of course, numerous modifications could be made to the embodiments described above without departing from the scope of the invention as defined in the appended claims.

The invention claimed is:

1. A retaining member and elongated cap assembly affixable to a jamb of a doorframe supporting a hinged door, the doorframe having a transversal axis extending along the hinged door in a closed configuration, the retaining member and elongated cap assembly comprising:

an elongated weatherstrip member having an anchor portion and a weatherstrip portion longitudinally co-extending with the anchor portion;

an elongated retaining member including an S-shaped segment superposed against the jamb and including an inner section, an intermediate section, and an outer section, extending substantially parallel to one another, the S-shaped segment further including an inner transversal section extending between the inner section and the intermediate section, and an outer transversal section extending between the outer section and the intermediate section, the outer section, the outer transversal section and the intermediate section of the S-shaped segment defining a U-shaped retaining channel configured to engage and retain the anchor portion of the weatherstrip member with the weatherstrip portion being at least partially superposed to the inner transversal section of the S-shaped segment, wherein each of the inner section, the intermediate section, the outer section, the inner transversal section, and the outer transversal section directly contact the jamb when the elongated retaining member is installed;

an elongated cap securable to the retaining member in a spaced-apart arrangement, the retaining member and the cap configured to jointly form a shielding chamber along an outer portion of the jamb when affixed thereto; and a door seal mounted to one of the elongated retaining member and the elongated cap, the door seal being spaced-apart from the inner section of the S-shaped segment along the transversal axis and extending inwardly into a door entrance.

2. The retaining member and elongated cap assembly according to claim 1, wherein the inner section of the S-shaped segment of the retaining member extends along an outer portion of the jamb when the S-shaped segment is superposed against the jamb.

3. The retaining member and elongated cap assembly according to claim 2, wherein the retaining member further comprises a branching segment projecting from the inner section of the S-shaped segment, away from the jamb along the transversal axis when in use, the door seal extending from the branching segment.

4. The retaining member and elongated cap assembly according to claim 1, wherein the door seal defines a lip protruding away from the jamb, when in use, at an angle with respect to a plane of the jamb.

5. The retaining member and elongated cap assembly according to claim 1, wherein the door seal is made of a material less rigid than a material of a remainder of the retaining member and elongated cap assembly.

6. The retaining member and elongated cap assembly according to claim 1, comprising inner ribs projecting within the retaining channel and configured to engage tabs protruding from the anchor portion of the weatherstrip member.

7. The retaining member and elongated cap assembly according to claim 2, wherein the S-shaped segment has opposite extremities and the retaining member further comprises a pair of jamb seals respectively projecting from the opposite extremities of the S-shaped segment and configured for sealingly contacting the jamb and wherein a first one of the pair of jamb seals respectively projects from the outer section of the S-shaped segment and a second one of the pair of jamb seals respectively projects from the inner section of the S-shaped segment, the jamb seals being the pair of jamb seals being sandwiched between the S-shaped segment and the jamb when the S-shaped segment is superposed against the jamb.

8. The retaining member and elongated cap assembly according to claim 1, wherein the elongated cap is shorter than a length of the jamb.

9. A jamb weatherstripping kit for a jamb of a doorframe supporting a hinged door and for use with an elongated weatherstrip member defining an anchor portion and a weatherstrip portion longitudinally co-extending with the anchor portion, the jamb weatherstripping kit comprising:

an elongated retaining member affixable to the jamb and comprising an S-shaped segment superposed against the jamb and including an inner section, an intermediate section, and an outer section, extending substantially parallel to one another, the S-shaped segment further including an inner transversal section extending between the inner section and the intermediate section, and an outer transversal section extending between the outer section and the intermediate section, the outer section, the outer transversal section and the intermediate section of the S-shaped segment defining a U-shaped retaining channel configured to engage and retain the anchor portion of the weatherstrip member, wherein each of the inner section, the intermediate section, the outer section, the inner transversal section, and the outer transversal section directly contact the jamb when the elongated retaining member is installed; and an elongated cap having opposite extremities, a first one of the opposite extremities being engageable with the elongated retaining member and a second one of the opposite extremities comprising a flexible seal to sealingly contact the jamb, the elongated cap being securable to the retaining member in a spaced-apart arrangement to at least partially cover the inner section of the S-shaped segment, the retaining member and the elongated cap being configured to jointly form a shielding chamber along an outer portion of the jamb when sealingly affixed thereto.

10. The jamb weatherstripping kit according to claim 9, wherein the shielding chamber is divided into an outward section and an inward section.

11. The jamb weatherstripping kit according to claim 9, wherein the inner section of the S-shaped segment of the retaining member extends along an outer portion of the jamb and bounds the shielding chamber therealong.

12. The jamb weatherstripping kit according to claim 9, wherein the retaining member further comprises a branching segment projecting from the inner section of the S-shaped segment, away from the jamb when in use and the retaining member further comprises a door seal extending from the branching segment, the door seal being configured to sealingly contact, in use, a face of the door parallely to the weatherstrip portion of the weatherstrip member when the door is closed.

13. The jamb weatherstripping kit according to claim 12, wherein the cap comprises a shielding wall extending in parallel with the inner section of the S-shaped segment when the cap is secured to the retaining member and bounding the shielding chamber and the branching segment has a hook portion, and the cap comprises a complementary hook projection transversally projecting from the shielding wall and engageable with the hook portion of the branching segment of the retaining member.

14. The jamb weatherstripping kit according to claim 13, wherein the cap and the retaining member further comprise complementary connectors respectively projecting transversally from the inner section of the S-shaped segment and the shielding wall of the cap, and engageable with each other and the shielding wall of the cap projects further outwardly of the door than the inner section of the S-shaped segment when the cap is secured to the retaining member, the cap further comprising a foot segment projecting transversally from the shielding wall and configured to contact the jamb outwardly of the retaining member.

15. The jamb weatherstripping kit according to claim 14, wherein the cap comprises a cap jamb seal projecting from an extremity of the foot segment of the elongated cap and configured for sealingly contacting the jamb.

16. The retainer member and the elongated cap assembly according to claim 1, further comprising a door sill assembly comprising:

a sill approach member having an upper surface and an outwardly extending interlock hook extending above the upper surface; and a sill threshold member connectable to the sill approach member and comprising a step portion and an outer supporting leg extending downwardly from the step portion, the outer supporting leg having a lower end abutting the upper surface of the sill approach member when connected thereto and including an inwardly extending interlock hook engageable with the outwardly extending interlock hook of the sill approach member when connected thereto, each one of the lower end of the outer supporting leg and the inwardly extending interlock hook comprising a seal member extending along a length of the sill threshold member and sealingly engaging a respective one of the upper surface of the sill approach member and the outwardly extending interlock hook of the sill approach member when connected thereto.

17. The retainer member and elongated cap assembly according to claim 16, wherein the sill approach member comprises a sloping portion and an inner supporting leg supporting the sloping portion, the inner supporting leg having a section extending above the upper surface of the sill approach member and including the outwardly extending interlock hook; the door sill assembly further comprising a sill structure having an outer portion and an inner portion, the sill approach member covering and being supported by the outer portion of the sill structure and the sill threshold member covering and being supported by the inner portion of the sill structure, the inner supporting leg of the sill approach member abutting an upper surface of the sill structure, the sill threshold member being connected to and supported by the sill structure, and the outer supporting leg of the sill threshold member extending outwardly of the inner supporting leg of the sill approach member.

18. The retainer member and elongated cap assembly according to claim 16, wherein the inwardly extending interlock hook of the sill threshold member extends below the outwardly extending interlock hook of the sill approach member when engaged together.

19. The retainer member and elongated cap assembly according to claim 16, wherein the sill threshold member is made by plastic co-extrusion with the seal members being made of a flexible plastic and a remaining portion of the sill threshold member being made of a rigid plastic.

20. A jamb weatherstripping assembly for a jamb of a doorframe supporting a hinged door, the jamb weatherstripping assembly comprising:

an elongated retaining member affixed to the jamb and comprising an S-shaped segment superposed against the jamb and having opposite extremities, the S-shaped segment including an inner section, an intermediate section, and an outer section extending substantially parallel to one another, the S-shaped segment further including an inner transversal section extending between the inner section and the intermediate section, and an outer transversal section extending between the outer section and the intermediate section, the S-shaped segment defining a U-shaped retaining channel, the retaining member comprising a pair of jamb seals respectively projecting towards the jamb from the opposite extremities of the S-shaped segment to sealingly contact the jamb, the pair of jamb seals being sandwiched between the S-shaped segment and the jamb, wherein each of the inner section, the intermediate section, the outer section, the inner transversal section, and the outer transversal section directly contact the jamb when the elongated retaining member is installed a weatherstrip member having an anchor portion engageable in the U-shaped retaining channel of the retaining member; and an elongated cap securable to the elongated retaining member in a spaced-apart arrangement, the retaining member and the cap configured to jointly form a shielding chamber along an outer portion of the jamb when affixed thereto.

21. The jamb weatherstripping assembly according to claim 20, wherein the S-shaped segment comprises a first loop forming the U-shaped retaining channel and a second loop frictionally engaging the jamb and the inner section of the S-shaped segment extends along an outer portion of the jamb.

22. The jamb weatherstripping assembly according to claim 21, wherein the retaining member further comprises a branching segment projecting from the second loop away from the jamb, the retaining member further comprises a door seal extending from the branching segment.

23. The jamb weatherstripping assembly according to claim 21, wherein a first one of the pair of jamb seals projects from an inward extremity of the first loop of the S-shaped segment and a second one of the pair of jamb seals projects from an outward extremity of the inner section.

* * * * *